US007097280B2

(12) United States Patent
Hubert et al.

(10) Patent No.: US 7,097,280 B2
(45) Date of Patent: Aug. 29, 2006

(54) PRINTHEADS HAVING IMPROVED HEATER CHIP CONSTRUCTION

(75) Inventors: Rick L. Hubert, Lexington, KY (US); George K. Parish, Winchester, KY (US); Kristi M Rowe, Richmond, KY (US); John G. Edelen, Versailles, KY (US); Paul W. Graf, Lexington, KY (US); Carl Sullivan, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 328 days.

(21) Appl. No.: 10/777,813

(22) Filed: Feb. 12, 2004

(65) Prior Publication Data

US 2005/0179728 A1 Aug. 18, 2005

(51) Int. Cl.
*B41J 2/05* (2006.01)

(52) U.S. Cl. ..... 347/44; 347/62

(58) Field of Classification Search ..... 347/40, 347/56–57, 61–63, 12

See application file for complete search history.

(56) References Cited

U.S. PATENT DOCUMENTS

| | | | | |
|---|---|---|---|---|
| 4,740,800 | A * | 4/1988 | Kyoshima | 347/67 |
| 5,467,115 | A | 11/1995 | Childers | |
| 5,499,042 | A | 3/1996 | Yanagawa | |
| 5,534,901 | A | 7/1996 | Drake | |
| 5,596,356 | A | 1/1997 | Lee | |
| 5,627,572 | A | 5/1997 | Harrington, III et al. | |
| 5,697,144 | A | 12/1997 | Mitani et al. | |
| 5,774,145 | A | 6/1998 | Morita et al. | |
| 5,798,780 | A | 8/1998 | Koizumi et al. | |
| 6,022,093 | A | 2/2000 | Arai et al. | |
| 6,024,430 | A | 2/2000 | Koitabashi et al. | |
| 6,106,106 | A | 8/2000 | Nakazawa et al. | |
| 6,182,907 | B1 | 2/2001 | Nakagawa et al. | |
| 6,193,343 | B1 | 2/2001 | Norigoe et al. | |
| 6,224,182 | B1 | 5/2001 | Nagoshi et al. | |
| 6,241,346 | B1 | 6/2001 | Takahashi | |
| 6,264,310 | B1 | 7/2001 | Toru et al. | |
| 6,328,397 | B1 | 12/2001 | Shimizu et al. | |
| 6,361,151 | B1 | 3/2002 | Shigemura | |
| 6,375,312 | B1 | 4/2002 | Ikeda et al. | |
| 6,402,297 | B1 | 6/2002 | Yamaguchi | |
| 6,431,682 | B1 | 8/2002 | Osada et al. | |
| 6,512,284 | B1 * | 1/2003 | Schulte et al. | 257/530 |
| 2001/0012036 | A1 * | 8/2001 | Giere et al. | 347/62 |
| 2001/0030673 | A1 | 10/2001 | Shigemura | |
| 2001/0045968 | A1 | 11/2001 | Hirayama | |

FOREIGN PATENT DOCUMENTS

| | | | |
|---|---|---|---|
| EP | 1164014 | A1 | 12/2001 |
| GB | 2232933 | A | 7/1990 |

(Continued)

*Primary Examiner*—David M. Gray
*Assistant Examiner*—Lisa M. Solomon
(74) *Attorney, Agent, or Firm*—Luedeka, Neely & Graham, P.C.

(57) ABSTRACT

An improved heater chip for an ink jet print head, the chip including an active heater array and an inactive heater array located adjacent to and extending away from the end of the active heater array. The inactive heater array provides a region adjacent the end of the active heater array that is substantially planar, and also provides a plurality of current paths which reduces energy differences between heater resistors adjacent the end of the active heater array and other heater resistors in the heater array.

17 Claims, 6 Drawing Sheets

FOREIGN PATENT DOCUMENTS

| | | | |
|---|---|---|---|
| JP | 02158346 | | 6/1990 |
| JP | 03284946 | | 12/1991 |
| JP | 5069570 | A2 | 3/1993 |
| JP | 6286186 | A2 | 10/1994 |
| JP | 2000255090 | A2 | 9/2000 |

* cited by examiner

PRINTHEADS HAVING IMPROVED HEATER CHIP CONSTRUCTION

FIELD OF THE INVENTION

The invention relates to heater chips for ink jet printers and specifically to print heads having improved heater chip construction.

BACKGROUND

Ink jet technology continues to be improved in order to increase printing speed and print quality or resolution. One means for improving print speed and quality is to increase the number of nozzle holes in an ink jet print head and to decrease the diameter of the nozzle holes. However, improvements in print speed and quality often result in operational problems not experienced with lower quality slower speed printers.

In an ink jet printer, ink is provided to the print head from an ink cartridge or supply tank. The ink flows from the tank through a connecting conduit from the ink cartridge through an ink via in a semiconductor chip or around the edges of a semiconductor chip and into ink flow channels and an ink chamber. Each ink chamber is situated in axial alignment with a corresponding nozzle hole and a heater resistor defined on the surface of the semiconductor chip. Electrical impulse energy applied to an ink ejector adjacent an ink chamber causes ink adjacent the ejector in the chamber to be forced through a nozzle hole onto a print medium. By selective activation of a plurality of ink ejectors on a print head, a pattern of ink dots are applied to the print medium to form an image.

Conventional ink jet print heads desire improvement, particularly with regard to the manufacture of heater chips for use with print heads. Particularly desired improvements in the manufacture of heater chips include improvements in the planarity of such chips and in the uniformity of the planarizing layer thickness. Defects in conventional chips result in print heads that are prone to misdirected ink drop ejection, poor nozzle plate adhesion, and reduced corrosion resistance.

Ink jet print heads typically include a print head body containing a semiconductor substrate and a nozzle plate attached to the substrate. The substrate/nozzle plate assembly is received by a chip pocket in the print head body. Ink is supplied to the substrate/nozzle assembly from an ink reservoir in the print head body generally opposite the chip pocket. The semiconductor substrate for a thermal print head is typically a silicon substrate containing a plurality of ink ejection devices such heater resistors formed on a device side thereof. These substrates are referred to as "heater chips."

FIG. 1 shows a portion of a prior art heater chip 10 having a plurality of heater resistors 12 formed on a device side 14 thereof. A nozzle plate 16 (FIG. 3) having ink ejection nozzle holes 18 corresponding to the heater resistor sites is generally attached to the chip 10. The device side 14 of the chip 10 also includes conductors 17 from one side of the heater resistors 12 to driver circuitry 19 for supplying electrical impulses from a printer controller to activate the heater resistors 12 for printing. A conductor 21 is connected from the opposite side of the heater resistors 12 to a common power conductor 23. Upon activation of the heater resistors 12, ink supplied through an ink via 20 in the chip 10 is caused to be ejected toward a print media through the nozzle holes 18 (FIG. 3). The chip 10 is configured for use with a top-shooter type print head, wherein the ink is ejected from the nozzle plate 16 attached to the device side 14 of the chip 10.

With reference to FIGS. 2A–2B and 3, the chip 10 contains various layers such as a first conductive metal layer 22, a passivation layer 24, and a cavitation protection layer 26 deposited on the device side 14 thereof. The resistors 12 and 33 are defined by a resistive layer 25 and each heater resistor 12 and 33 corresponds to one of the nozzle holes 18 in the nozzle plate 16 for heating and ejecting ink toward a print media. As will be noted, there is a significant topographical variation 27 adjacent end 28 of the heater array.

FIG. 3 shows the nozzle plate 16, not to scale, attached to the heater chip 10. The topographical variation 27 complicates attachment of the nozzle plate 16 and results in a deformation in the orientation and shape of the nozzle hole 18, particularly near orifice 30 of the nozzle hole 18. Deformation of the shape of the nozzle hole 18 results in an ink ejection path, represented by the arrow 32, which deviates from the desired ink ejection path, represented by arrow 34. The angle of the desired but previously unachievable path 34 relative to the resistor is preferably about 90 degrees. The angle represented by the intersection of arrows 32 and 34 in FIG. 3 is exaggerated to illustrate deviation from an ideal ejection path. The angle of the path 32 typically achieved generally ranges from about 90 to about 90.6 degrees. Although a 0.6° deviation from ideal may appear to be minor, the resulting droplet misplacement is significant given the distance the droplet travels before impacting the recording medium and the high placement precision required for quality printing.

As will further be noted, the heater resistor 33 at the end 28 of a heater array 35 tends to have a relatively higher current path resistance, and hence different energy, than the interior heater resistors 12. This higher resistance results from the availability of only a single current path through the heater resistor 12 adjacent the end 28 of the heater array 35, as represented by arrows 36.

Accordingly, there is a continuing need for improved ink jet printheads as printing speed and print resolution continue to increase. There is also a need for improved methods for making high resolution ink jet printheads.

SUMMARY OF THE INVENTION

With regard to the foregoing, the invention relates to a heater chip for an ink jet print head, to ink jet print heads incorporating such chips, and to methods for making such chips. In a preferred embodiment, the chip includes a substrate having a device side including an active heater array located on the device side having a plurality of active heater resistors that may be placed in electrical communication with a driver circuit for supplying electrical impulses to activate the heater resistors for printing, the active heater array terminating to define an end of the active heater array. An inactive heater array is located adjacent to and extending away from the end of the active heater array.

The inactive heater array provides a region adjacent the end of the active heater array that is substantially planar, and also provides a plurality of current paths which reduce energy differences in heaters resistors adjacent the end of the active heater array when compared to other heater resistors in the heater array.

The present invention provides an improved heater chip construction that achieves a number of specific advantages over conventional heater chips and print heads. For example, the invention enhances the planarity of the chip and reduces the energy difference between heater resistors adjacent the end of a heater array, resulting in improved print head performance and life. Enhanced planarity is achieved by including an additional, but inactive, heater structure adjacent the end of the active heater array. The inactive heater structure serves to relocate the abrupt topographical variations sufficiently remote from the end of the active heater array. Reduced topographical variations facilitate attachment of a nozzle plate to the chip in a manner that improves nozzle plate adhesion and also reduce distortion of ink ejection paths through nozzle holes in the nozzle plate. The improved planarity also results in an increased thickness of the planarizing layer on the chip adjacent the end of an active heater array, thereby improving corrosion resistance of the active heater array structure.

The inactive heater structures also increase the available current paths, thereby decreasing the energy difference of heater resistors adjacent the end of the heater array compared to other heater resistors in the heater array. A reduction of the energy difference achieved by the chip construction helps provide more consistent heater resistor energy characteristics, resulting in improved ink bubble performance and print performance.

BRIEF DESCRIPTION OF THE DRAWINGS

The above and other aspects and advantages of the invention will become further apparent by reference to the following detailed description of preferred embodiments when considered in conjunction with the accompanying drawings in which.

DETAILED DESCRIPTION OF THE PREFERRED EMBODIMENTS

The present invention provides an improved heater chip having one or more inactive heater structures, such as inactive heater resistors, located adjacent the end of the active heater array. Use of inactive heater resistors advantageously shifts abrupt topographical variations away from the end of the active heater array so that the topographical variations have considerably less impact on a nozzle bore angle and ink droplet trajectory. The inactive heater resistors also increase the available current paths, thereby decreasing the energy difference between heater resistors adjacent the end of the heater array and other heater resistors in the heater array.

Figure 4:
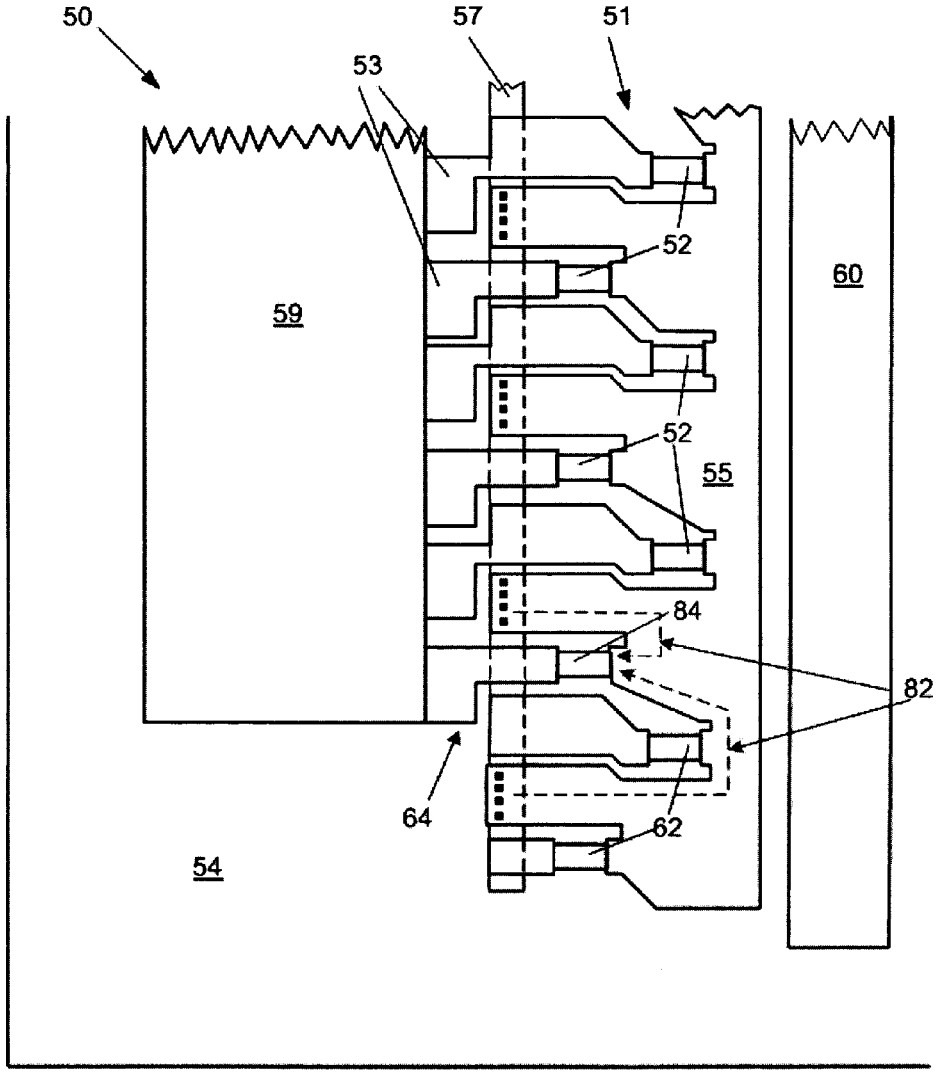
FIG. 4 is a plan view, not to scale, of an improved chip layout in accordance with a preferred embodiment of the invention.

In a preferred embodiment, and with reference to FIG. 4, the invention provides a heater chip 50 having a heater array 51 containing a plurality of active heater resistors 52 formed on a device side 54 thereof. A nozzle plate 56 (FIG. 6) having ink ejection nozzle holes 58 corresponding to the active heater resistor sites is generally attached to the chip 50. The device side 54 of the chip 50 also includes conductors 53 from one side of the active heater resistors 52 to driver circuitry 59 for supplying electrical impulses from a printer controller to activate the heater resistors 52 for printing. The opposite side of the active heater resistors 52 is connected by conductor 55 to common power conductor 57. Upon activation of the active heater resistors 52, ink supplied through an ink via 60 in the chip 50 is caused to be ejected toward a print media through the nozzle holes 58. The chip 50 as shown is configured for use with a top-shooter type print head wherein ink is ejected from the nozzle plate 56 attached to the device side 54 of the chip.

One or more inactive heater resistors 62 is provided on the chip 50 beginning at a location adjacent end 64 of the array 51 of the active heater resistors 52 and continuing in a direction away from end 64 of the array 51 of active heaters 52. For a heater chip 50 having at least about one hundred of the active heaters 52 defining the active heater array 51, it is preferred to provide from about one to about four of the inactive heater resistors 62.

The overall dimension of the chip 50 preferably ranges from about three to about seven millimeters wide by from about eight to about seventeen millimeters long, and is about 0.6 millimeters thick. The via 60 is preferably provided by a single slot or a plurality of openings in the chip 50 made by a dry etch process and having an overall dimension of from about 0.2 to about 0.4 millimeters wide by from about four to about thirteen millimeters long. It will be appreciated that other inactive structures may be used in place of inactive heater resistors 62 to provide the benefits of the invention described in more detail below.

Figure 5A:
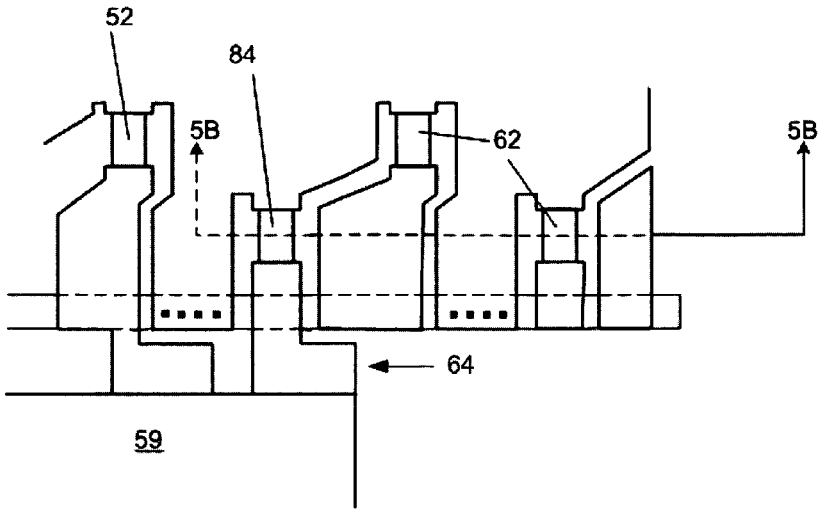
FIG. 5A is a partial plan view, not to scale, of a portion of the improved chip layout of FIG. 4.
Figure 5B:
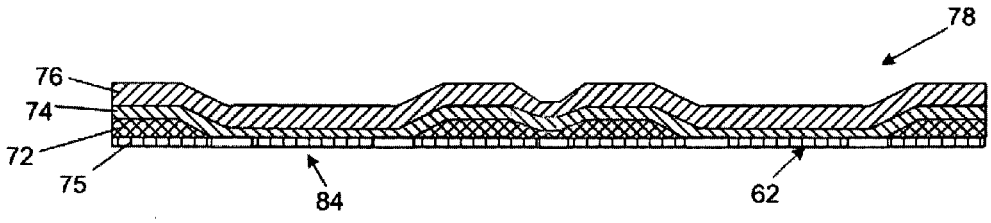
FIG. 5B is a partial cross-sectional view, not to scale, along lines 5B–5B of the improved chip layout of FIG. 4.

With reference to FIGS. 5A and 5B, the chip 50 preferably contains various layers such as conductive metal layer 72, passivation layer 74, and cavitation protection layer 76 deposited on the device side 54 thereof. The active resistors 52 and 84 are defined in a resistive layer 75 and each active heater resistor 52 corresponds to one of the nozzle holes 58 in the nozzle plate 56 for heating and ejecting ink toward a print media. The inactive heater resistors 62 are preferably formed in the same manner and at substantially the same time as the active heaters 52 and 84, except that they are not connected to the driver circuitry 59.

Figure 1:
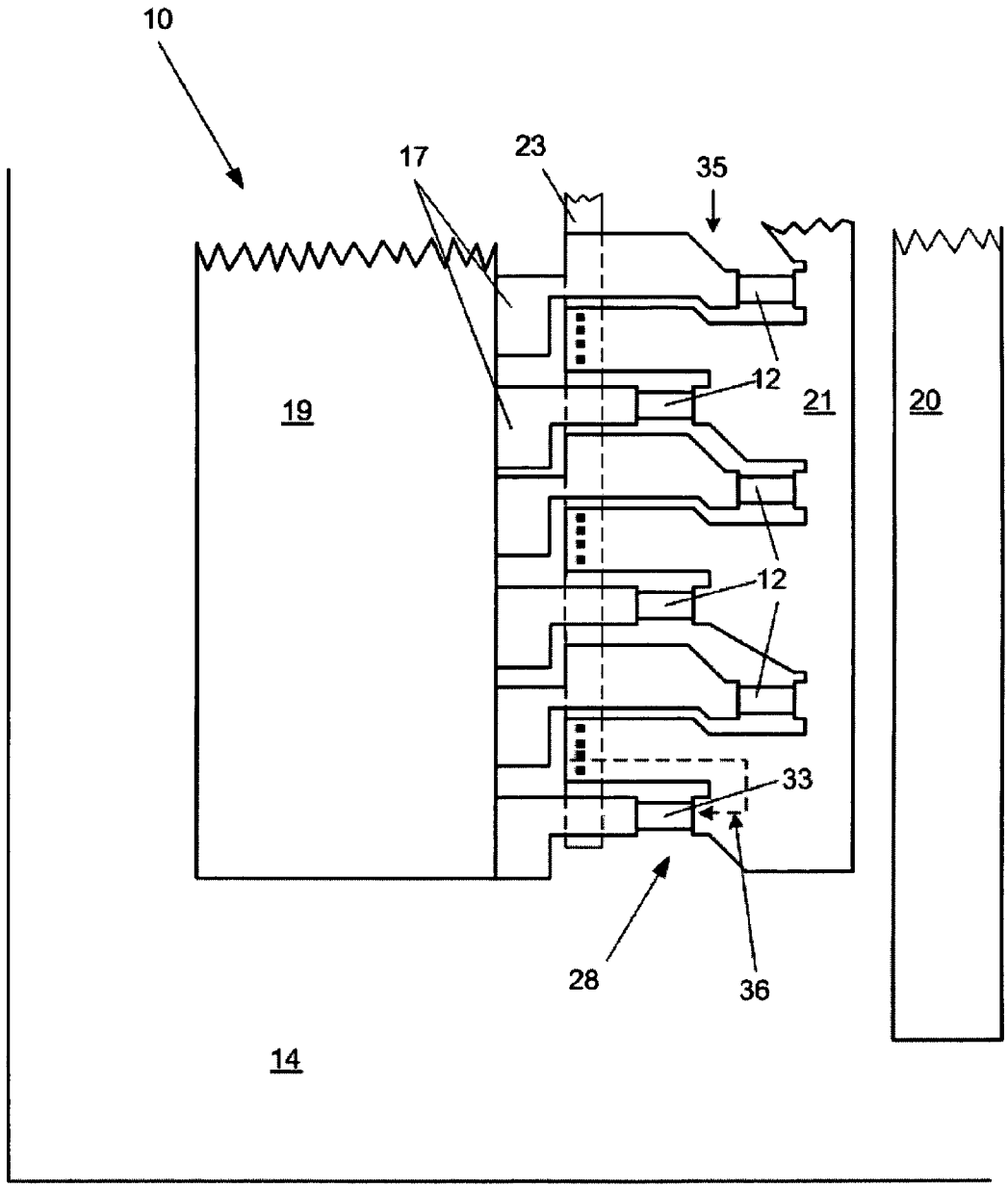
Fig. 1 Prior Art
FIG. 1 is a plan view, not to scale, of a prior art chip layout.
Figure 2A:
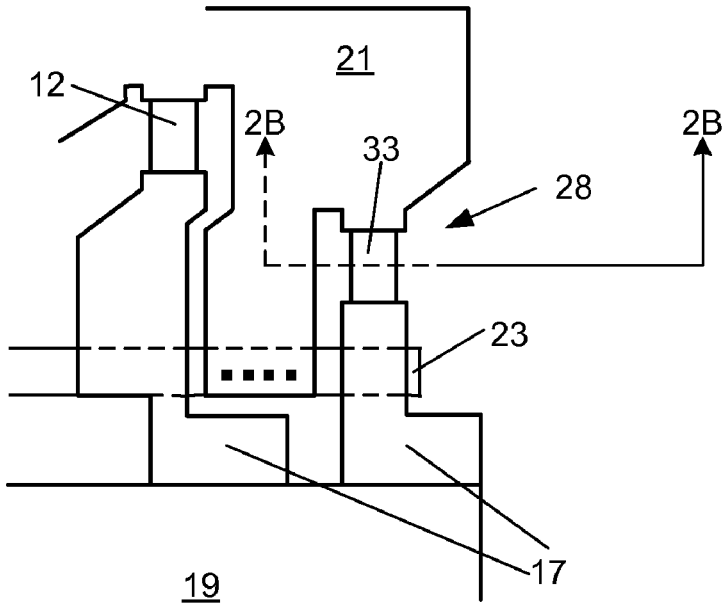
Fig. 2A Prior Art
FIG. 2A is a partial plan view, not to scale, of a portion of the prior art chip layout of FIG. 1.
Figure 2B:
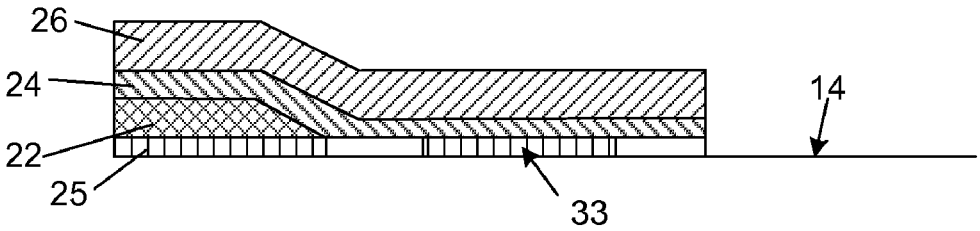
Fig. 2B Prior Art
FIG. 2B is a partial cross-sectional view, not to scale, along lines 2B–2B of FIG. 2A of a prior art chip.
Figure 3:
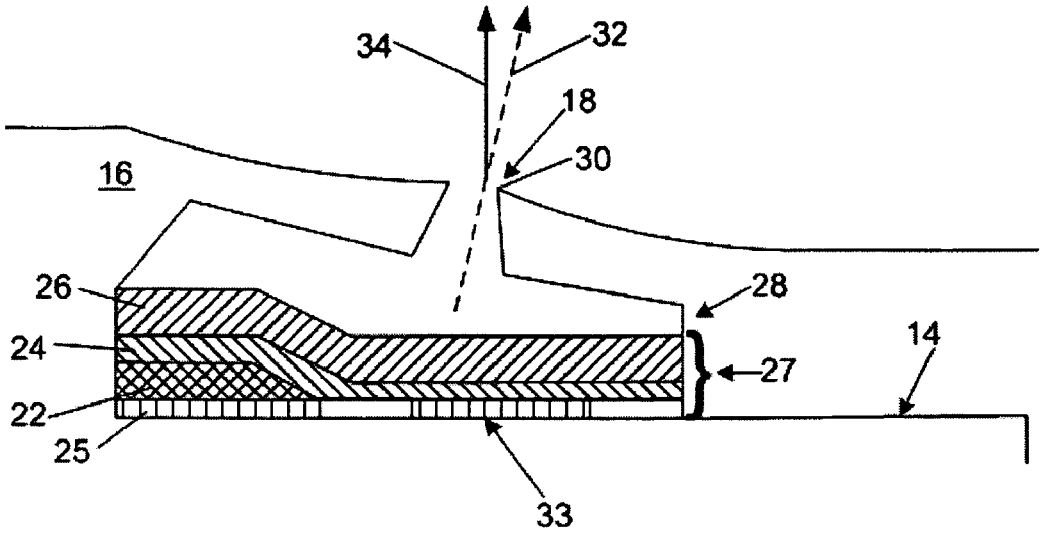
Fig. 3 Prior Art
FIG. 3 is a representational cross-sectional view, not to scale, of a prior art heater chip illustrating a nozzle plate bonded thereto.
Figure 6:
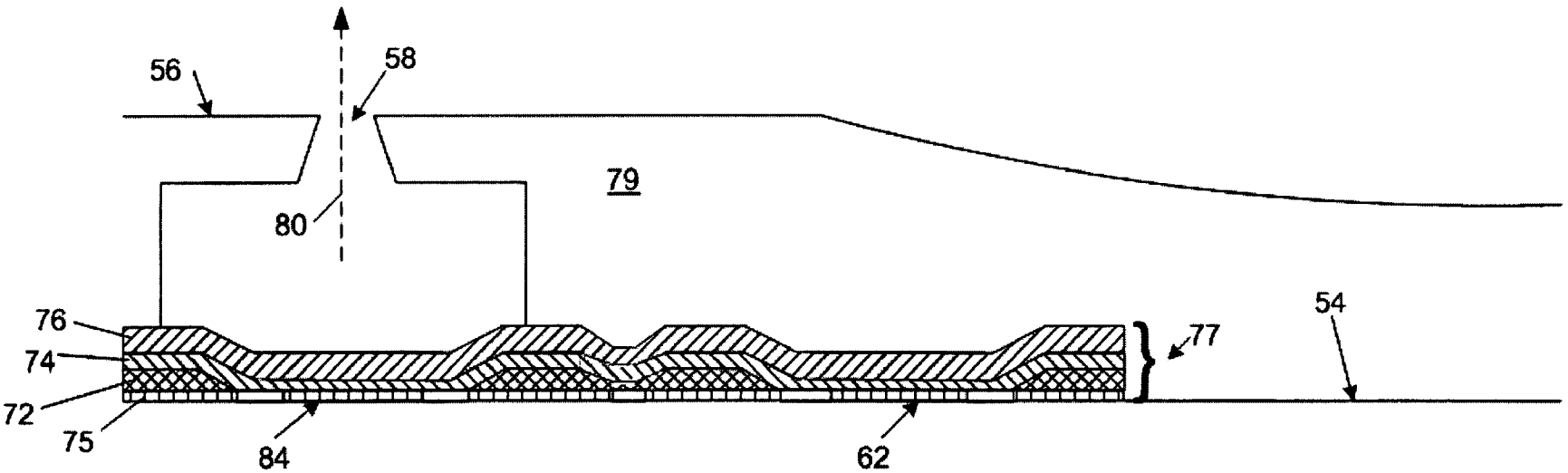
FIG. 6 is a representational cross-sectional view, not to scale, of an improved heater chip according to the invention and illustrating a nozzle plate bonded thereto.

FIG. 6 shows the nozzle plate 56 attached to the heater chip 50. As will be noted, topographical variation 77 is less abrupt as compared to the topographical variation 27 shown in FIG. 3, and the most abrupt portion of the variation 77 is shifted away from the end 64 of the active heater array 51 such that a region 79 adjacent the end 64 of the active heater array 51 is substantially planar. This facilitates attachment of the nozzle plate 56 to the chip 50 and advantageously avoids any significant deformation in the orientation and shape of the nozzle hole 58, achieving an ejection path, represented by the arrow 80 that is significantly more desirable than the path 32 discussed in connection with FIG. 3 and substantially corresponds to the desired path 34.

The resulting topography of the chip 50, which is substantially more planar than the topographies of prior chips, particularly with respect to the regions 78 immediately adjacent the end 64 of the active heater array 51, also advantageously enables deposition of a more planar and consistent passivation and cavitation layers, resulting in improved chip performance and life. For example, it has been observed that passivation and planarizing layers, such as those provided by depositing a photoresist of the type useful for inhibiting corrosion of the print head components, have improved consistency and planarity, resulting, among other things, in improved corrosion resistance.

As will further be noted, the inclusion of the inactive heater resistors 62 at the end 64 of the active heater array provides a plurality of current paths, as represented by arrows 82 (FIG. 4). This advantageously reduces the current path resistance, and hence reduces the energy differences between heater resistors 84 adjacent the end 64 of the heater array and other heater resistors 52 in the heater array 51. This helps to provide more consistent energy characteristics for the region of the active heaters 52 and 84 and improves ink bubble performance and print performance.

The foregoing description of certain exemplary embodiments of the present invention has been provided for purposes of illustration only, and it is understood that numerous modifications, alterations, substitutions, or changes may be made in and to the illustrated embodiments without departing from the spirit and scope of the invention.

What is claimed is:

1. A heater chip for an ink jet print head, the chip comprising:

a substrate having a device side including an active heater array located on the device side having a plurality of active heater resistors that may be placed in electrical communication with a driver circuit for supplying electrical impulses to activate the heater resistors for printing, the active heater array terminating to define an end of the active heater array; and an inactive heater array located adjacent to and extending away from the end of the active heater array; wherein the inactive heater array provides:

(a) a region adjacent the end of the active heater array that is substantially planar, and (b) a plurality of current paths for an active heater resistor adjacent the end of the active heater array which reduce energy differences between a heater resistor adjacent the end of the active heater array and other heater resistors in the active heater array.

2. The heater chip of claim 1, wherein the chip is configured for use with a top-shooter type print head.

3. The heater chip of claim 1, further comprising a nozzle plate attached to the chip and having ink ejection nozzles located at positions corresponding to the active heater resistors.

4. The heater chip of claim 1, wherein the inactive heater array comprises one or more inactive heater resistors.

5. The heater chip of claim 1, wherein the inactive heater array comprises passivation, cavitation protection, and resistive layers.

6. A heater chip for an ink jet print head, the chip comprising:

a substrate having a device side including an active heater array located on the device side with a plurality of active heater resistors that may be placed in electrical communication with a driver circuit for supplying electrical impulses to activate the heater resistors for printing, the active heater array terminating to define an end of the active heater array; and an inactive structure located adjacent to and extending away from the end of the active heater array; wherein the inactive structure provides a region adjacent the end of the active heater array that is substantially planar, and wherein the inactive structure is effective to reduce current path resistance variations between an active heater resistor adjacent the end of the active heater array and other active heater resistors in the active heater array.

7. The heater chip of claim 6, wherein the inactive structure provides a plurality of current paths for one or more of the active heater resistors adjacent the end of the active heater array which reduces an energy difference between the one or more of the active heater resistors adjacent the end of the active heater array and other heater resistors in the active heater array.

8. The heater chip of claim 6, wherein the inactive structure comprises one or more inactive heater resistors.

9. The heater chip of claim 6, wherein the chip is configured for use with a top-shooter type print head.

10. The heater chip of claim 6, further comprising a nozzle plate attached to the chip and having ink ejection nozzles located at positions corresponding to the active heater resistors.

11. The heater chip of claim 6 wherein the inactive structure comprises passivation, cavitation protection, and resistive layers.

12. An ink jet print head containing a heater chip according to claim 6.

13. A method for making a heater chip for an ink jet print head, the method comprising forming an active heater array on a device side of a substrate, the active heater array having a plurality of active heater resistors that may be placed in electrical communication with a driver circuit for supplying electrical impulses to activate the heater resistors for printing, with the active heater array terminating to define an end of the active heater array; and providing an inactive structure at a location on the device side of the substrate adjacent to and extending away from the end of the active heater array, wherein the inactive structure provides a region adjacent the end of the active heater array that is substantially planar, and wherein the inactive structure is effective to reduce current path resistance variations between an active heater resistor adjacent the end of the active heater array and other active heater resistors in the active heater array.

14. The method of claim 13, wherein providing an inactive structure comprises providing one or more inactive heater structures.

15. The method of claim 13, wherein the the acts of forming an active heater array and providing an inactive structure are performed at substantially the same time.

16. The method of claim 13, wherein the inactive structure provides a plurality of current paths for the active heater resistor adjacent the end of the active heater array which reduce energy differences between the heater resistors adjacent the end of the active heater array and other heater resistors in the active heater array.

17. The heater chip of claim 6, wherein the inactive structure is effective to reduce current path resistance through active heater resistors adjacent to the end of the active heater array.

* * * * *